US010330124B2

(12) United States Patent
Baltes et al.

(10) Patent No.: US 10,330,124 B2
(45) Date of Patent: Jun. 25, 2019

(54) ACCUMULATOR DEVICE

(71) Applicant: HYDAC TECHNOLOGY GMBH, Sulzbach/Saar (DE)

(72) Inventors: Herbert Baltes, Losheim (DE); Peter Kloft, Ransbach-Baumbach (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 0 days.

(21) Appl. No.: 15/111,203

(22) PCT Filed: Dec. 19, 2014

(86) PCT No.: PCT/EP2014/003445

§ 371 (c)(1),
(2) Date: Jul. 13, 2016

(87) PCT Pub. No.: WO2015/106792

PCT Pub. Date: Jul. 23, 2015

(65) Prior Publication Data

US 2016/0333896 A1 Nov. 17, 2016

(30) Foreign Application Priority Data

Jan. 14, 2014 (DE) ..... 10 2014 000 380

(51) Int. Cl.
*F15B 1/24* (2006.01)

(52) U.S. Cl.
CPC ..... *F15B 1/24* (2013.01); *F15B 2201/31* (2013.01); *F15B 2201/405* (2013.01); *F15B 2201/605* (2013.01)

(58) Field of Classification Search
CPC ..... F15B 1/24
USPC ..... 138/31, 30, 26
See application file for complete search history.

(56) References Cited

U.S. PATENT DOCUMENTS 2,406,197 A * 8/1946 Christensen ..... F15B 1/24 138/31
2,417,873 A * 3/1947 Huber ..... F15B 1/24 138/31
2,721,446 A * 10/1955 Bumb ..... F15B 1/24 138/31

(Continued)

FOREIGN PATENT DOCUMENTS

DE 37 28 555 3/1989
DE 201 02 031 4/2001

(Continued)

OTHER PUBLICATIONS

International Search Report (ISR) dated May 18, 2015 in International (PCT) Application No. PCT/EP2014/003445.

*Primary Examiner* — Craig M Schneider
*Assistant Examiner* — David R Deal
(74) *Attorney, Agent, or Firm* — Wenderoth, Lind & Ponack, L.L.P.

(57) ABSTRACT

A piston accumulator has a dividing piston (22) inside an accumulator housing (2) that separates a chamber (28) containing a working gas, such as nitrogen, from a chamber (26) containing a working fluid, such as hydraulic oil. The dividing piston (22) is longitudinally movably guided in a guide tube (24). The guide tube (24) is arranged inside the accumulator housing (2) and extends at least partially along the housing longitudinal axis (10).

13 Claims, 1 Drawing Sheet

(56) References Cited

U.S. PATENT DOCUMENTS

| | | | | | |
|---|---|---|---|---|---|
| 4,538,972 | A * | 9/1985 | Gooden | F15B 1/265 | 138/31 |
| 4,632,279 | A * | 12/1986 | Donaldson | H02G 1/14 | 174/88 R |
| 4,644,976 | A * | 2/1987 | Peter | F15B 1/24 | 138/31 |
| 4,678,010 | A * | 7/1987 | Purvis | F15B 1/24 | 138/31 |
| 4,693,276 | A * | 9/1987 | Fulmer | F15B 1/24 | 138/31 |
| 4,714,094 | A * | 12/1987 | Tovagliaro | F15B 1/24 | 138/31 |
| 5,024,250 | A * | 6/1991 | Nakamura | F15B 1/08 | 138/104 |
| 6,065,814 | A * | 5/2000 | Nishii | B60T 8/4068 | 138/31 |
| 2012/0273076 | A1 | 11/2012 | Basley | | |
| 2013/0048126 | A1 | 2/2013 | Engelberg | | |
| 2013/0186597 | A1* | 7/2013 | Clark | F17C 1/06 | 165/104.19 |

FOREIGN PATENT DOCUMENTS

| | | |
|---|---|---|
| DE | 10 2005 035 749 | 2/2007 |
| DE | 10 2010 001 200 | 7/2011 |
| DE | 10 2011 082 726 | 3/2013 |
| EP | 2 881 593 | 6/2015 |
| FR | 1 135 747 | 5/1957 |
| FR | 2 199 066 | 4/1974 |

* cited by examiner

ACCUMULATOR DEVICE

FIELD OF THE INVENTION

The invention relates to an accumulator device, in particular in the form of a piston accumulator, having a floating piston. The piston is inside an accumulator housing and separates two media chambers from each other. In particular, it separates a chamber containing a working gas, such as nitrogen, from a chamber containing a working fluid, such as hydraulic oil.

BACKGROUND OF THE INVENTION

Accumulator devices of this type are known in a variety of sizes and embodiments and are available on the market. They are widely used in hydraulic systems of various kinds, for example for storing hydraulic energy, for damping or smoothing pressure fluctuations, and the like. Frequently accumulator devices in the form of piston accumulators are also used in hydraulic systems in working equipment having hydraulic drive units, for instance mobile machines, such as excavators, forklifts, loaders or mobile cranes.

Due to the varied and numerous applications, accumulator devices are to be produced in large quantities. The amount of manufacturing costs constitutes an economically extremely important factor.

SUMMARY OF THE INVENTION

The invention addresses the problem of providing an accumulator device of the aforementioned type, which can be produced particularly efficiently and cost-effectively and which, moreover, is characterized by a particularly favorable operational behavior.

According to the invention, this problem is basically solved by an accumulator device having, as one essential feature of the invention, a floating piston that is longitudinally movably guided in a guide. The guide is arranged inside the accumulator housing and extends at least partially along the longitudinal axis of the housing. Because, according to the invention, a guide is provided for the floating piston within the accumulator housing, the accumulator housing can be produced efficiently and at low cost. No expensive internal machining is required for a direct guiding of the floating piston on the inner wall of the housing.

A particular advantage of the invention is that an identical unit of a guide and the associated floating piston can be used for varying accumulator housing sizes. A modular design can then be realized for the production of accumulator devices having varying dimensions, resulting in a particularly efficient production at low cost. The presence of a guide extending in the longitudinal direction of the accumulator housing further improves the performance by homogenizing the working gas due to reduced turbulence occurring during operation.

The longitudinal extension of the guide may be sized such that the floating piston remains in the guide in every possible movement position thereof.

In a particularly advantageous manner, the guide can be formed of a hollow cylinder, preferably having uniform wall thickness, whose free end is fixed on the inside of the accumulator housing. A corresponding hollow cylinder, at whose wall there is no pressure gradient due to the movability of the floating piston in operation, can be produced relatively inexpensively because of the thin walls and can be attached to the inside of the housing by a weld.

The guide may be advantageously incorporated into the housing, in such a manner that the floating piston uses parts of the guide and the parts of the accumulator housing, at which one end of the hollow cylinder has been fastened in an impermeable manner, to delimit the media chamber holding the working fluid.

In doing so, the parts of the accumulator housing can be part of an upper housing part, in particular in the form of a cover, which follows on its inside at least in part the free frontal outer contour of the floating piston, which contour faces the upper housing part. If the working fluid is not pressurized, this results in a reliable, full-surface contact of the floating piston at the housing wall.

For this purpose, the frontal outer contour of the floating piston can be convex in order to rest against the concave inside of the upper housing part as soon as the floating piston has reached one of its end positions. The working fluid is then completely displaced from the assignable media chamber.

Advantageously, the accumulator housing and the guide is arranged largely concentrically to each other. The outer side of the guide maintains, at least over a central part of the accumulator housing, a constant distance from the inside of the accumulator housing.

The arrangement can advantageously be made in such a manner that the free end of the guide leads into the direction of a bottom part of the accumulator housing. The bottom part is designed as a hemisphere and is preferably an integral part of the cup-shaped lower part of the housing.

The longitudinal extension of the hollow cylinder forming the guide can be designed particularly advantageously such that the free end of the guide terminates in a transition area in which the cylindrically shaped central part of the accumulator housing merges into the hemispherical bottom part of the housing.

The accumulator housing may be formed particularly advantageously with a weld joint between the upper housing part and with the adjoining housing part covered by the guide while maintaining a predetermined radial distance. The guide then forms a protective cover of the weld during welding.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
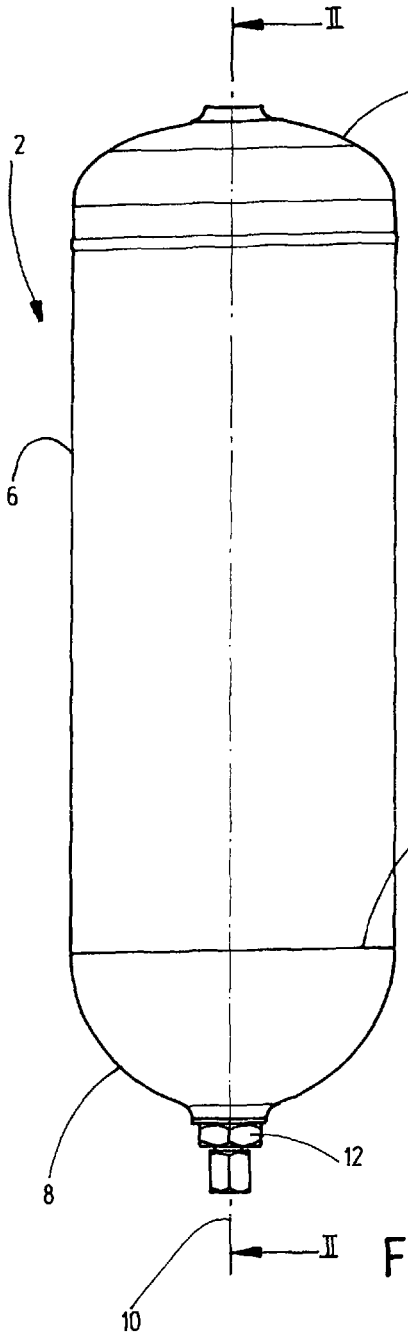
FIG. 1 is a side view of an exemplary embodiment of an accumulator device according to the invention.

The exemplary embodiment depicted in the figures has an accumulator housing 2 having a circular-cylindrical main housing part 6, an upper housing part 4 and a bottom part 8. The main housing part 6 and the bottom part 8 form a cup, which is closed except for a gas-filling connector 12 located coaxially to the longitudinal axis 10 of the accumulator. The main housing part 6 and the bottom part 8 are integrally formed, for instance in the form of a deep-drawn part made of a metallic material. The bottom part 8 has the shape of a hemisphere, which merges into a transition region 14 in the cylindrical main housing part 6. The upper housing part 4 has the shape of a shell with a concavely shaped inside surface 16 and is connected by a weld 18 to the cylindrical main housing part 6 as a fastener of the housing 2. A fluid port 20 is provided concentrically to the longitudinal axis 10 on the upper housing part 4 for an working fluid concerned, such as hydraulic oil.

Figure 2:
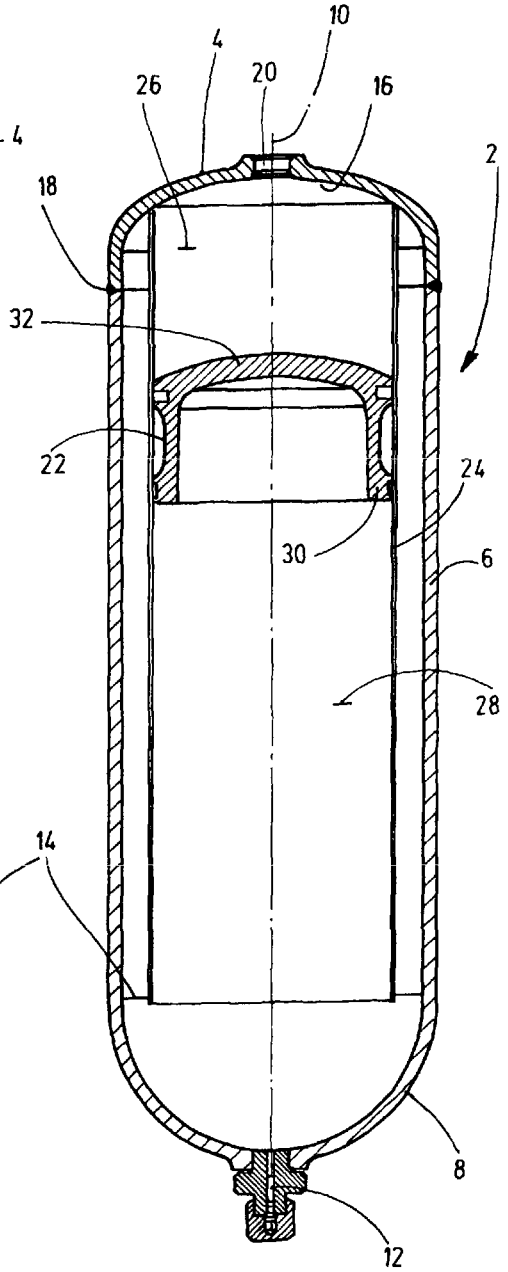
FIG. 2 is a side view in section along the line II-II of the accumulator device of FIG. 1.

Although the accumulator device forms a piston accumulator, the accumulator housing 2 is designed in the manner of a housing for a bladder accumulator, i.e. the surface of the inside of the housing 2 is not machined, as is required for conventional piston-type accumulators to form a sliding and guiding surface for the respective floating piston. In a simple and inexpensive manner, as in the invention, this machining function is taken over or replaced by a guide for the floating piston 22. The guide has a hollow cylinder 24, which extends in the housing 2 concentrically to the axis 10. The guide inside surface forms the guide track for the floating piston 22. One end of the hollow cylinder 24 is impermeably fixed to the upper housing part 4 by welding. Its opposite free end extends into the transition area 14, where the cylindrical main housing part 6 merges into the bottom part 8. As the upper end of the hollow cylinder 24 is impermeably closed by the upper housing part 4, the space above the floating piston 22 located in the hollow cylinder 24 forms the fluid side, separated from the gas side 28, which is located in the remaining part of the hollow cylinder 24 and outside its open aperture in the remaining housing area, adjacent to the bottom part 8, by the floating piston 22. As can be seen in FIG. 2, the floating piston 22 has the shape of a cup, the depth of which is determined by the axial extension of a piston skirt 30, which extends downwards from the cup bottom 32, overhead in FIG. 2. The axial length of the piston skirt 30 is dimensioned such that at the end position of the traversing position occupied by the floating piston 22 in the absence of pressurized working gas, [the cup] contacts the bottom part 8 with its piston skirt 30. For this axial length of the hollow cylinder 24, whose open end extends at least into the transition area 14 between the bottom part 8 and the main part 6, the floating piston 22 therefore remains at the lower end position in guiding engagement with the hollow cylinder 24.

As can be seen, the upper surface of the cup bottom 32 of the floating piston 22 is convexly curved. The curvature is adapted to the concave curvature of the inside 16 of the upper housing part 4 in such a manner that the floating piston 22 in its upper end position, i.e. in the absence of fluid pressure, contacts the inside 16 over the complete surface. Thus, at this end position, the accumulator body 2 is free of any residual volume of remaining liquid.

In operation, the floating piston 22 in the hollow cylinder takes a position corresponding to the pressure balance between the fluid side 26 and gas side 28. No differential pressure is effective on the wall of the hollow cylinder 24, i.e. the hollow cylinder 24 can be formed as a thin-walled tube using very little material. The assembly of a hollow cylinder 24 and a floating piston 22 can be used as a prefabricated module or block for varying accumulator designs. Optionally, for the same tube diameter and identically constructed floating piston 22, varying pipe lengths can be provided for different lengths of the accumulator housing. In this way, the invention allows for a cheap construction of accumulator devices in the form of piston accumulators.

While one embodiment has been chosen to illustrate the invention, it will be understood by those skilled in the art that various changes and modifications can be made therein without departing from the scope of the invention as defined in the claims.

The invention claimed is:

1. A piston accumulator, comprising:

an accumulator housing having an axial length along a longitudinal axis thereof;

a floating piston in said accumulator housing separating a gas media chamber from a working liquid chamber inside said accumulator housing;

a guide in which said floating piston is movable within said accumulator housing along said longitudinal axis of said accumulator housing, said guide being arranged inside said accumulator housing, extending at least partially along said longitudinal axis and being a hollow tube, said hollow tube having a transverse diameter equal to a transverse diameter of said floating piston and having a length along said longitudinal axis adapted to a length of said accumulator housing along said longitudinal axis allowing said floating piston and said hollow tube to be prefabricated for assembly in said accumulator housing;

only a first axial end of said hollow tube being fastened impermeably and directly to an axially facing axial inside end surface of said accumulator housing with an opposite second axial end of said hollow tube being free of direct attachments, thereby delimiting said working liquid chamber by an inside surface of said hollow tube and an axial end surface of said floating piston, said floating piston being engageable with said hollow tube and parts of said accumulator housing, said parts of said accumulator housing including a first end housing part having said axial inside end surface, said axial inside end surface having a contour conforming to a free frontal outer contour of said floating piston facing said axial inside end surface of said first end housing part, said free frontal contour of said floating piston being convexly shaped to rest against said axial inside end surface of said first end housing part that is concavely shaped when said floating piston reaches an end position thereof in which working liquid is completely displaced from said working liquid chamber; and a welded joint between said parts of said accumulator housing being over said hollow tube while maintaining a radial distance therefrom.

2. A piston accumulator according to claim 1 wherein said hollow tube comprises a longitudinal extension along said longitudinal axis to retain said floating piston therein in every possible movement of said floating piston.

3. A piston accumulator according to claim 1 wherein said hollow tube is cylindrical with a uniform thickness.

4. A piston accumulator according to claim 1 wherein said accumulator housing and said hollow tube are concentric; and a radially facing outside surface of said hollow tube being at constant distance from a radial inside surface of said accumulator housing at least in a central part of said accumulator housing.

5. A piston accumulator according to claim 1 wherein said hollow tube comprises an opposite second axial end extending in a direction of and spaced from a second axial end surface of said accumulator housing, said first and second end surfaces being opposite one another, said end surfaces being concavely curved.

6. A piston accumulator according to claim 1 wherein said hollow tube terminates in a transition area where a cylindrically shaped central part merges into a hemispherical end part of said accumulator housing.

7. A piston accumulator according to claim 1 wherein said end of said hollow tube is fastened to said axial inside end surface of said accumulator housing by direct welding thereof.

8. A piston accumulator according to claim 1 wherein said inside surface of said end housing part that is concavely shaped is entirely located within said guide.

9. A piston accumulator according to claim 1 wherein said floating piston comprises a second axial piston end surface opposite said free frontal outer contour, said free frontal contour forming a first axial piston end surface, said first and second axial piston end surfaces being spaced along said longitudinal axis by a distance greater than a spacing of said second axial end of said hollow tube from a second end housing part of said accumulator housing opposite said first end housing part along said longitudinal axis.

10. A piston accumulator according to claim 1 wherein said parts of said accumulator housing consists of a one-piece and unitary cylindrical main housing part extending between said first end housing part and a second end housing part, each of said first and second end housing parts being a unitary, one-piece structure and being cup-shaped.

11. A piston accumulator, comprising:

a hollow accumulator housing having a longitudinal axis, having opposite first and second axial housing ends and having a liquid port in said first housing end;

a hollow guide tube having opposite first and second axial tube ends and extending coaxially to said longitudinal axis, only said first tube end being impermeably and directly fixed to an axially facing and radially extending first end surface of said first housing end about said liquid port, said hollow guide tube having a radially facing outer surface radially spaced from a radially facing inner surface of said accumulator housing, said second axial tube end being a free end unattached directly to said accumulator housing;

a floating piston slidably and sealably movable inside said hollow tube;

a working liquid chamber being in fluid communication with said liquid port and being defined by said first axial housing end surface of said first housing end surrounded by said hollow guide tube, by an axially extending and radially facing inside surface of said hollow guide tube between said first axial housing end surface and a first axial piston end surface of said floating piston facing said first axial housing end surface and by said first axial piston end surface; and a gas chamber defined by an inside volume of said accumulator housing not taken by said working liquid chamber, said hollow guide tube and said floating piston.

12. A piston accumulator according to claim 11 wherein said floating piston comprises a second axial piston end surface opposite said first axial piston end surface, said first and second axial piston end surfaces being spaced along said longitudinal axis by a distance greater than a spacing of said second axial tube end from said second axial housing end along said longitudinal axis.

13. A piston accumulator, comprising:

an accumulator housing having an axial length along a longitudinal axis thereof;

a floating piston in said accumulator housing separating a gas media chamber from a working liquid chamber inside said accumulator housing;

a guide in which said floating piston is movable within said accumulator housing along said longitudinal axis of said accumulator housing, said guide being arranged inside said accumulator housing, extending at least partially along said longitudinal axis and being a hollow tube, said hollow tube having a transverse diameter equal to a transverse diameter of said floating piston and having a length along said longitudinal axis adapted to a length of said accumulator housing along said longitudinal axis allowing said floating piston and said hollow tube to be prefabricated for assembly in said accumulator housing; and an end of said hollow tube being fastened impermeably and directly to an axially facing inside end surface of said accumulator housing, thereby delimiting said working liquid chamber by an inside surface of said hollow tube and an axial end surface of said floating piston, said floating piston being engaged with said hollow tube and being engagable with parts of said accumulator housing, said hollow tube being only connected to said accumulator housing at said end of said hollow tube; and a welded joint between first and second parts of said accumulator housing, said welded joint being over said hollow tube while maintaining a radial distance therefrom.

* * * * *